United States Patent [19]

Doss

[11] 4,414,107

[45] Nov. 8, 1983

[54] FLOTATION REAGENT

[75] Inventors: Robert M. Parlman; Clarence R. Bresson; Richard C. Doss, all of Bartlesville, Okla.

[73] Assignee: Phillips Petroleum Company, Bartlesville, Okla.

[21] Appl. No.: 393,239

[22] Filed: Jun. 29, 1982

[51] Int. Cl.[3] ..... B03D 1/14

[52] U.S. Cl. ..... 209/166; 209/167; 252/61

[58] Field of Search ..... 209/4, 5, 10, 166, 167; 252/61

[56] References Cited

U.S. PATENT DOCUMENTS

| | | | |
|---|---|---|---|
| 3,032,198 | 5/1962 | Keen et al. | 209/167 |
| 3,102,854 | 9/1963 | Atwood | 209/4 |
| 3,488,294 | 1/1970 | Annaud et al. . | |
| 3,846,419 | 11/1974 | Seeliger et al. . | |
| 4,284,244 | 8/1981 | Hoover et al. | 209/5 |

*Primary Examiner*—Bernard Nozick

[57] ABSTRACT

A process for the recovery of molybdenum and copper values from an ore comprising the same is provided which comprises employing an oxazine compound as a collection agent.

5 Claims, No Drawings

FLOTATION REAGENT

This invention relates to a novel process for the recovery of molybdenum sulfide from an ore comprising the same.

Froth flotation is a process for separating minerals from ores. In a froth flotation process, the ore is crushed and wet ground to obtain a pulp. Additives such as collectors, or mineral flotation agents, frothing agents, suppressants and the like are added to the pulp to assist in subsequent flotation steps in separating valuable minerals from the undesired portion of the ore. The pulp is then aerated to produce a froth at the surface. The minerals which adhere to the bubbles or froth are skimmed or otherwise removed and the mineral-bearing froth is collected and further processed to obtain the desired minerals.

A continued need exists in the ore recovery and refining technology for effective compositions and processes for enhanced recovery of mineral sulfides, such as molybdenum sulfides, in ore flotation processes.

It is thus an object of this invention to provide a novel process for the recovery of molybdenum sulfide from an ore comprising the same.

Other aspects, objects, and the several advantages of the instant invention will become apparent upon reading this specification and the appended claims.

In accordance with the present invention, we have discovered that in a froth flotation process for the recovery of molybdenum values from an ore comprising the same an improvement is made by employing an effective amount of at least one oxazine compound, represented by the general formulas:

(I) 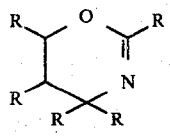 and (II) 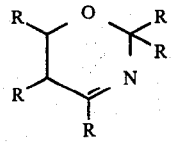

where R is selected from the group consisting of H, $CH_3$, or $CH_3CH_2$, as a collection agent for said molybdenum sulfide.

Examples of oxazines which can be used in the process of the present invention include:

1,3,2-oxazine
1,3,4-oxazine
2,2,4,5,6-pentamethyl-2H-1,3 oxazine
2,4,4,5,6-pentamethyl-4H-1,3-oxazine
5,6-dihydro-2,4,4,6-tetramethyl-4H-1,3-oxazine
5,6-dihydro-2,2,4,6-tetramethyl-2H-1,3-oxazine
5,6-dihydro-2,6-dimethyl-5-ethyl-4H-1,3-oxazine and mixtures thereof.

In the process of the instant invention, an effective amount of an oxazine compound is employed as a collection agent for values of molybdenum from an ore comprising the same. For the purposes of this invention, an effective amount of an oxazine is defined as that amount of the oxazine necessary to effectuate the desired molybdenum sulfide recovery from an ore comprising the same. Generally, the concentration of oxazine employed is from about 0.005 to 0.5 lb. per ton of ore, more preferably from about 0.01 to 0.2 lb. per ton of ore.

In a preferred embodiment of this invention at least one oxazine as defined is employed as a collection agent for molybdenum values by adding said oxazine as a collection agent to the grind of an ore comprising the same.

The process of this invention can be carried out utilizing any froth flotation apparatus. Examples of such flotation machines are the Agitor (Galigher Co.), Denver D-12 (Denver Equipment Co.) and the Fagergren (Western Manufacturing Co.). Smaller laboratory scale apparatus such as the Hallimond cell can also be used.

Any frothing agent known in the art can be utilized in the present invention. Examples include polypropylene or polyethylene glycol and their corresponding monomethyl or monoethyl ethers, isophorone, and methyl isobutyl carbinol.

The following examples illustrate the present invention.

EXAMPLE I

This example describes a standard ore flotation process procedure used to evaluate mining chemicals. The example includes two controls and an inventive run used on a single ore type. To a ball mill was charged 2020 grams (2 weight percent moisture) of a crushed Mo/Fe-containing ore obtained from the Thompson Creek Mine, Custer County, Idaho. Also charged to the mill was 1000 grams of water, 1.25 grams lime and 11 drops (0.08 lb/ton methyl isobutyl carbinol (MIBC) frother and the mixture ground for 27.5 minutes. The slurry was transferred to a 5 liter Denver flotation cell along with enough water to make about a 35 weight percent aqueous solids solution. The pH was 9. With air passing through the agitator, the mixture was floated for 6 minutes while being stirred at 1900 rpm. The foam was periodically removed and the total concentrate filtered, dried and analyzed. Another control run was made by repeating the flotation step except 0.18 lb/ton of an aromatic oil (PMCA, Phillips Petroleum Co.) was employed as a collector and was added at the grind step. The flotation step was again repeated except the inventive collector, 5,6-dihydro-2,4,4,6-tetramethyl-4H-1,3-oxazine (available from the Aldrich Chemical Co.) was used instead of the aromatic oil. These results are listed in Table I where it is shown the oxazine collector (invention) is equivalent to the aromatic oil (Control B) in Mo recovery, 96.25% and 96.45% respectively, and significantly better than when no collector is employed (Control A), 96.25% and 91.2% respectively.

TABLE I

Effect of Collector on Mineral Recovery
2020 Grams Ore (Thompson Creek Mine)

| | Control A | Control B | | Invention | |
|---|---|---|---|---|---|
| Runs: | 1 | 2 | 3 | 4 | 5 |
| A. Rougher Tails: | | | | | |
| Sample Wt., grams | 1996 | 2002 | 2008 | 2005 | 1995 |
| Fe, grams | 19.96 | 22.0 | 19.08 | 22.06 | 21.95 |
| Fe, % | 1.0 | 1.1 | .95 | 1.1 | 1.1 |
| Mo, grams | .345 | .144 | .132 | .116 | .189 |
| Mo, % | .017 | .007 | .007 | .006 | .009 |
| B. Rougher Concentrate: | | | | | |
| Sample Wt., grams. | 17.4 | 13.6 | 12.45 | 14.81 | 15.56 |
| Fe, grams | .516 | .64 | .58 | .77 | .81 |
| Fe, % | 2.96 | 4.73 | 4.72 | 5.22 | 5.20 |
| Mo, grams | 3.57 | 4.09 | 3.40 | 3.90 | 3.95 |
| Mo, % | 20.5 | 30.14 | 27.33 | 26.34 | 25.40 |
| C. % Recovery | | | | | |
| Fe | 2.5 | 2.8 | 2.9 | 3.4 | 3.6 |
| (Average) | (2.5) | (2.85) | | (3.5) | |
| Mo | 91.2 | 96.6 | 96.3 | 97.1 | 95.4 |

TABLE I-continued

| Effect of Collector on Mineral Recovery 2020 Grams Ore (Thompson Creek Mine) | | | | | |
|---|---|---|---|---|---|
| | Control A | Control B | | Invention | |
| Runs: | 1 | 2 | 3 | 4 | 5 |
| (Average) | (91.2) | (96.4) | | (96.25) | |

EXAMPLE II

This example describes another flotation process similar to that described in Example I but with a different type ore. The example includes one control and the invention run. To a table top ball mill was charged 1000 grams of a crushed Mo//Fe/Cu-containing ore obtained from the Climax Molybdenum Co., a division of Amax, Inc. Also charged to the mill was 500 grams water, 0.2 gram lime, 0.027 lb/ton pine oil, 0.05 lb/ton Syntex (monoglyceride of cocoanut oil), 0.66 lb/ton sodium silicate, 0.38 lb/ton vapor oil, 0.03 lb/ton Nokes Reagent (60% NaOH/40% $P_2S_5$ (usually as a 25% aqueous solution) and 0.005 lb/ton sodium cyanide and the mixture ground for 4 minutes 8 seconds. The slurry was transferred to a 2.5 liter Denver flotation cell along with enough water to make about a 35 weight percent aqueous solids solution. The pH was adjusted to 8.5. The agitator was started at 1100 rpm and the mixture was conditioned for 2 minutes and floated for 5 minutes. The concentrate float was filtered, dried and analyzed. The procedure was repeated except the vapor oil collector was replaced with 0.19 lb/ton of the inventive collector, 5,6-dihydro-2,4,4,6-tetramethyl-4H-1,3-oxazine. It is noted that only 0.19 lb/ton oxazine could be employed because at the higher level, 0.38 lb/ton, excessive frothing occurred. These results are listed in Table II where it is seen the oxazine is comparable to the vapor oil in Mo recovery and nearly equal to vapor oil in Cu recovery. The advantage of the oxazine being that only half as much oxazine is needed as vapor oil to get comparable results.

TABLE II

| Effect of Collector on Mineral Recovery 1000 Grams Ore (Climax Molybdenum Co.) | | | | |
|---|---|---|---|---|
| | .38 lb/ton Vapor Oil | | .19 lb/ton Oxazine[a,b] | |
| | 1 | 2 | 3 | 4 |
| A. Rougher Tails: | | | | |
| Sample Wt., grams | 970 | 977 | 960 | 969 |
| Fe, grams | 15.4 | 15.2 | 15.6 | 16.2 |
| Fe, % | 1.59 | 1.56 | 1.62 | 1.67 |

TABLE II-continued

| Effect of Collector on Mineral Recovery 1000 Grams Ore (Climax Molybdenum Co.) | | | | |
|---|---|---|---|---|
| | .38 lb/ton Vapor Oil | | .19 lb/ton Oxazine[a,b] | |
| | 1 | 2 | 3 | 4 |
| Cu, grams | .039 | .039 | .029 | .048 |
| Cu, % | .004 | .004 | .003 | .005 |
| Mo, grams | .48 | .52 | .53 | .50 |
| Mo, % | .049 | .053 | .055 | .051 |
| B. Rougher Concentrate | | | | |
| Sample Wt., grams | 28.08 | 22.72 | 42.57 | 28.02 |
| Fe, grams | .56 | .55 | .85 | .56 |
| Fe, % | 2.0 | 2.4 | 2.0 | 2.0 |
| Cu, grams | .045 | .036 | .038 | .025 |
| Cu, % | .16 | .16 | .09 | .09 |
| Mo, grams | 1.16 | 1.17 | 1.22 | 1.12 |
| Mo, % | 4.15 | 5.14 | 2.88 | 4.00 |
| C. % Recovery | | | | |
| Fe | 3.5 | 3.5 | 5.2 | 3.3 |
| (Average) | | (3.5) | | (4.2) |
| Cu | 53.6 | 48.0 | 56.7 | 34.2 |
| (Average) | | (50.8) | | (45.5) |
| Mo | 70.7 | 69.2 | 69.8 | 69.1 |
| (Average) | | (70.0) | | (69.5) |

[a]5,6-Dihydro-2,4,4,6-tetramethyl-4H—1,3-oxazine
[b]at .38 lb/ton the cell was overfrothed Reasonable variations and modifications from the foregoing disclosure of the present invention are possible without departing from the spirit thereof.

We claim:

1. In an ore froth flotation wherein molybdenum values are recovered from an ore comprising the same in the froth, the improvement which comprises employing an effective amount of at least one oxazine compound, represented by the general formulas:

(I) 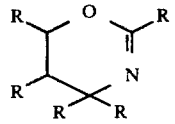 and (II) 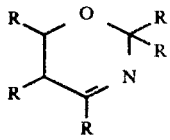

where R is selected from the group consisting of H, $CH_3$, or $CH_3CH_2$, as a collection agent for molybdenum sulfide.

2. A process according to claim 1 wherein said oxazine is 5,6-dihydro-2,4,4,6-tetramethyl-4H-1,3-oxazine.

3. A process according to claim 2 wherein said oxazine is employed in an amount from about 0.005 lb/ton of ore to about 0.5 lb/ton of ore.

4. A process according to claim 3 wherein said oxazine is added in an amount from about 0.01 lb/ton of ore to about 0.2 lb/ton of ore.

5. A process according to claim 4 wherein 5,6-dihydro-2,4,4,6-tetramethyl-4H-1,3-oxazine is added to a grind.

* * * * *